US007709819B2

(12) United States Patent
Smith

(10) Patent No.: US 7,709,819 B2
(45) Date of Patent: May 4, 2010

(54) APPARATUS AND METHOD FOR LONG-TERM STORAGE OF ANTIMATTER

(75) Inventor: Gerald A. Smith, Scottsdale, AZ (US)

(73) Assignee: Positronics Research LLC, Scottsdale, AZ (US)

( * ) Notice: Subject to any disclaimer, the term of this patent is extended or adjusted under 35 U.S.C. 154(b) by 103 days.

(21) Appl. No.: 12/175,856

(22) Filed: Jul. 18, 2008

(65) Prior Publication Data

US 2010/0012864 A1 Jan. 21, 2010

(51) Int. Cl.
*H05H 13/00* (2006.01)

(52) U.S. Cl. ..... 250/493.1; 376/127; 376/156

(58) Field of Classification Search ..... 250/493.1; 376/127, 156

See application file for complete search history.

(56) References Cited

U.S. PATENT DOCUMENTS 2,938,752 A 2/1957 Atkinson et al.
4,867,939 A * 9/1989 Deutch ..... 376/156
5,118,950 A 6/1992 Bahns et al.
5,206,506 A 4/1993 Kirchner
5,502,303 A * 3/1996 Gonzalez-Lepera ..... 250/252.1
5,948,310 A 9/1999 Shon et al.
5,977,554 A * 11/1999 Smith et al. ..... 250/493.1
6,160,263 A 12/2000 Smith et al.
6,414,331 B1 7/2002 Smith et al.
6,576,916 B2 6/2003 Smith et al.
6,606,370 B1 8/2003 Kasprowicz
6,813,330 B1 11/2004 Barker et al.

OTHER PUBLICATIONS

Paul L. Csonka: "Undulators for efficient positron production", Radiation Phys. and Chemistry, vol. 68, 663-68 (2003).
Randall G. Hulet & Daniel Kleppner: "Rydberg Atoms in "Circular" States", Phys. Rev. Lett., vol. 51, No. 16, 1430-33 (1983).
Robert Lutwak, Jeffery Holley, Pin Peter Chang, Scott Paine, Daniel Kleppner & Theodore Ducas: "Circular states of atomic hydrogen", Phys. Rev. A, vol. 56, No. 2, 1443-52 (1997).
H. Maeda, et al.: "Microwave Manipulation of an atomic electron in a classical orbit", Science, vol. 307, 1757-60 (2005).

(Continued)

*Primary Examiner*—Kiet T Nguyen
(74) *Attorney, Agent, or Firm*—Duane Morris LLP

(57) ABSTRACT

A long-term antimatter storage device that may be energized by a low power magnetron and can function autonomously for hundreds of hours on the energy provided by batteries. An evacuated, cryogenic container is arranged with a source of positrons and a source of electrons positioned in capture relation to one another within the container so as to allow for the formation of a plurality of positronium atoms. A microwave resonator is located within the container forming a circularly polarized standing wave within which the plurality of positronium atoms rotate. Radioactive sources for small stores and low energy positron accelerators for large stores are used to efficiently fill the device with positronium in seconds to minutes. The device may also be arranged to provide for the extraction of positrons. A method for storing antimatter is also provided.

22 Claims, 4 Drawing Sheets

OTHER PUBLICATIONS

J. Usukura, K. Varga & Y. Suzuki: "Signature of existnence of the positronium molecule", Phys. Rev. A, vol. 58. No. 3, 1918-31 (1998).
M. A. Green: "The effect of low temperature cryocoolers on the development of low temperature superconducting magnets", Lawrence Berkeley Nat. Lab., Berkeley CA 94720, USA, manuscript received Sep. 18, 2000.
Christophe Boisseau, Ionel Simbotin & Robin Cote: "Macrodimers: Utralong range Rydberg Molecules", Phys. Rev. Lett., vol. 88, No. 13, 133001-1 to -4 (2002).
"Semiclassical and Other Methods for Understanding Molecular Collisions and Chemical Reactions", S. Sen et al. eds., Collaborative Computational Project on Molecular Quantum Dynamics, Daresbury, United Kingdom (2005).
Maciej Kalinski, J. H. Eberly, J. A. West & C. R. Stroud, Jr.: "Rutherfod atom in quantum theory", Phys. Rev. A, vol. 67, 032503-1 to -5 (2003).
Iowa Bialynicki-Birula et al.: "Lagrange equilibrium points in celestial mechanics and nonspreading wave packets for strongly driven Rydberg electrons", Phys. Rev. Lett., vol. 73, No. 13, 1777-80 (1994).
Zofia Bialynicki-Birula & Iwo Bialynicki-Birula: "Radiative decay of Trojan wave packets", Phys. Rev. A, vol. 56, No. 5, 3623-25 (1997).
Dominique Delande, Jakub Zakrzewski & Andreas Buchleitner: "A wave packet can be a stationary state", Europhysics Lett., vol. 32, 17 (1995).
U. Hararth, J. Lowalski, R. Neumann, S. Noehte, K. Scheffzek & G. Putlitz: "Confocal Fabry—Perot microwave resonator at 48 GHz for high-resolution spectroscopy", J. Phys. E: Sci. Instrum. 20, 409-12 (1987). Printed in the UK.
Edison P. Liang & Charles D. Dermer: "Laser cooling of positronium", Optics Comm., vol. 65, No. 6, 419-24 (1998).
A.P. Mills, Jr. & M. Leventhal: "Can we measure the gravitational free fall of cold Rydberg state positronium?", Nucl. Inst. and Meth. in Phys. Res. B, vol. 192, 102-06 (2002).
P. Wallyn, W. Mahoney, P. Durouchoux & C. Chapuis: "The positronium radiative combination spectrum: Calculation in the limits of thermal positrons and low densities", Service D'Astrophysique (1996). Printed in France.
Kazimierz Rzazewski & Bernard Piraux: "Circular Rydberg orbits in circularly polarized microwave radiation", Phys. Rev. A, vol. 47, No. 3, R1612-15 (1993).
Anabel Peregrine-Smew, David Farrelly & T. Uzer: Comment on "Circular Rydberg orbits in circularly polarized microwave radiation", Phys. Rev. A, vol. 51, No. 5, 4293-94 (1995).
C.Y. Lee, J.M> Hettema, C.H. Cheng, C.W.S. Conovert & T.F. Gallagher: "Circular and elliptically polarized microwave ionization of Na Rydberg atoms," J. Phys. B: At. Opt. Phys. 29, 3401-15 (1996). Printed in the UK.
Panmimg Fu, T.J. Scholz, J.M. Hettema & T.F. Gallagher: "Ionization of Rydberg atoms by a circularly polarized microwave field," Phys. Rev. Lett., vol. 64, No. 5, 511-14 (1990).
B.M. Jelenkovic, A.S. Newbury, J.J. Bollinger, T.B. Mitchell & W.M. Itano: "Sympathtically laser-cooled positrons," Nuclear Instruments and Methods in Physics Research B, 192, 1117-127 (2002).
D. DeMille, D.R. Glenn & J. Petricka: "Microwave traps for cold polar molecules," Eur. Phys. J. D, vol. 31, 375-384 (2004).

* cited by examiner

APPARATUS AND METHOD FOR LONG-TERM STORAGE OF ANTIMATTER

FIELD OF THE INVENTION

The present invention generally relates to devices for capturing and storing antimatter and, more particularly to an antimatter trap that can store relatively large, useful quantities of antimatter for extended periods in the form of positronium.

BACKGROUND OF THE INVENTION

Antimatter comprises a positively charged electron (positron) and a negatively charged proton (antiproton). A positron is the anti-particle of an electron, and is an elementary particle having the same mass and the opposite charge as an electron. When positrons are implanted in a solid they are rapidly thermalized and annihilate with electrons. There are three known electrically neutral species of antimatter, one formed by combining equal numbers of positrons and antiprotons, one formed by combining equal numbers of protons and antiprotons, and positronium (Ps) which is formed from a mixture of electrons and positrons. Positronium has the lowest rest mass of any known atom. It is known that a positron and an electron briefly form an electron-positron pair (via coulomb forces) when the two particles meet in a molecular crystal or in an amorphous solid material, and then the pair annihilates. The positron-electron pair (positronium) behaves in a manner similar to a particle in a bound state.

Storage of lone positrons, however, is severely limited by the intrinsic inter-particle repulsive electric force, the so-called space charge force. From Coulomb's Law it is possible to compute that $10^{13}$ positrons at the center of a sphere of volume 100 cc (density=$1\times10^{11}$/cc) creates a static electric potential at the surface of the sphere equal to 500 kV. Thus an external potential of 500 kV is required to prevent a positron from escaping the sphere. These parameters represent severe limits to trapping of large numbers of positrons and the formation of stable quantities of positronium.

This annihilation problem may be circumvented by formation of the electrically neutral positronium atom. Unfortunately, the lifetime of positronium in its ground state is short, less than two hundred nanoseconds (ns). This is due to self-annihilation, wherein the positronium annihilates from the singlet state (with anti-parallel electron and positron spins) into two gamma rays, or from the triplet state (with parallel spins) into three gamma rays. From basic quantum statistics considerations, formation of positronium in vacuum is 75% triplet and 25% singlet. In addition, in the non-vacuum situation that is routinely encountered, the positron in the positronium atom can annihilate with a so-called bachelor electron that is attached to a neighboring, ordinary matter atom within the environment surrounding the positronium atom. This is called pick-off annihilation. If the positron and bachelor electron form a singlet state, annihilation takes place at a high rate (8 $ns^{-1}$). This leads to a rapid depletion of triplet states. Depending upon the exact materials in the surrounding environment, and their density, in a matter of picoseconds (ps) to nanoseconds (ns) the fraction of spin triplet states can be reduced from 75% to 3% or less. Therefore, any device that claims to store Ps for periods of time significantly greater than a few hundred ns must create an environment that inhibits both positronium self and pick-off annihilations.

Positronium Formation, Orbits and Self-Annihilation

As will be understood by those skilled in the art, a complete description of the positronium (Ps) atom 2 requires a quantum mechanical treatment in which each quantum state requires specification of a four-fold set of quantum numbers. These include the principal quantum number n, the angular momentum quantum number l, measured in units of $\hbar$, or Planck's constant divided by $2\pi$ or, about $1.05\times10^{-34}$ J-sec, the magnetic quantum number m, and the spin quantum number, +/−½. The relationship between n and l is l=0, 1, 2, 3, 4 . . . , or n−1, and the relationship between l and m is −l<m<+l. With these four quantum numbers a detailed description of the Ps quantum state can be constructed. The Correspondence Principle (CP) teaches that as n becomes large, quantum mechanical solutions to atomic and molecular problems can be viewed accurately from a classical viewpoint. As a consequence, the following description of the preferred embodiments of the invention will rely upon the CP, as appropriate, to simplify solutions to otherwise complicated problems.

Circular Rydberg States

The formation of Ps atom 2 typically starts with an electron 4, that is attached to an atom, interacting at a large distance with a positron 6. In order to conserve energy and momentum a third body, e.g., the atomic ion associated with electron 4, must participate in the interaction. The initial binding of electron 4 and positron 6 often takes place in a highly excited circular state (n~100-200) commonly referred to in the art as a Rydberg state. When a positron possessing a large amount of angular momentum captures an electron so as to form a Ps atom, known physical laws of conservation of angular momentum require that the positron necessarily transfers its angular momentum to the newly formed Ps atom in the form of a large value of l, e.g., l~n−1. This large value of l, along with specification of m, defines a circular orbit. Under normal physical conditions, this unstable Rydberg Ps atom 2 decays by spontaneous sequential emission of single photons ($\Delta n=1$) so as to decay in a stepwise fashion. The time required for the paired electron 4 and positron 6 to reach a ground state, from a circular orbit, and annihilate, in quantum mechanical terms is $\tau_A=1.08\times10^{-10}\ n^{5.236}$ seconds. For example, if an extraordinarily long time on the atomic scale, is used, e.g., $\tau_A$=1 day=8.64×104 seconds, then principal quantum number n=702, resulting in a radius r of the resulting circular Ps atom 2 of 0.1 $n^2$ nanometers. Thus for n=702, r equals 49 micrometers (μm), forming an extraordinarily large atom. The binding energy E of this Ps atom is $-6.8/n^2$ eV or $-1.38\times10^{-5}$ electron-Volts (eV). This energy, expressed in units of Kelvin temperature (K), is 0.17 K, or 0.05% of room temperature. To make long-term storage of Ps atoms practical storage devices and methods would have to be operated at this temperature or below. If not, the Ps atom is ionized by collisions with atoms in the surrounding medium. This is very often a difficult temperature regime requiring the implementation of very special and expensive techniques.

Known neutral atom traps have a complex implementation, limited efficiency, and limited mass storage capacity. U.S. Pat. Nos. 5,977,554 and 6,160,263, both entitled "Container for Transporting Antiprotons" issued on Nov. 2, 1999, and Dec. 12, 2000, respectively, to Gerald A. Smith et al., and U.S. Pat. Nos. 6,414,331 and 6,576,916, both entitled "Container for Transporting Antiprotons and Reaction Trap" issued on Jul. 2, 2002 and Jun. 10, 2003, to Gerald A. Smith et al., disclose a container for transporting antiprotons, including a dewar having an evacuated cavity and a cryogenically cold wall. A plurality of thermally conductive supports are disposed in thermal connection with the cold wall and extend into the cavity. An antiproton trap is mounted on the extending supports within the cavity. A scalable cavity access port selectively provides access to the cavity for selective introduction into and removal from the cavity of the antiprotons. The container is capable of confining and storing antiprotons while they are transported via conventional terrestrial or airborne methods to a location distant from their creation. An electric field is used to control the position of the antiprotons relative to the magnetic bottle that confines the antiprotons.

In U.S. Pat. No. 6,813,330, issued to Barker et al., a device is suggested for capturing and storing positronium that includes an antimatter trap having a three-dimensional or two-dimensional photonic band gap structure containing at least one cavity. The positronium atoms are stored in the cavity or in an array of cavities. The photonic band gap structure apparently blocks premature annihilation of the excited species by preventing decays to the ground state. Although, Barker et al., suggest that their device also blocks pickoff annihilation processes, no facility is taught for that effect.

SUMMARY OF THE INVENTION

The present invention provides a long-term antimatter storage device that may be energized by a low power magnetron and can function autonomously for hundreds of hours on the energy provided by batteries. Radioactive sources for small stores and low energy positron accelerators for large stores can be used to efficiently fill the device in seconds to minutes. The device may also be arranged to provide for the extraction of positrons. In one embodiment, an evacuated, cryogenic container is arranged with a source of positrons and a source of electrons positioned in capture relation to one another within the container so as to allow for the formation of a plurality of positronium atoms. A microwave resonator is located within the container forming a circularly polarized standing wave within which the plurality of positronium atoms rotate.

In one embodiment of the invention, a long-term antimatter storage container includes an evacuated, cryogenic container with sources of positrons and electrons arranged in capture relation to one another within the container so as to allow for the formation of a plurality of positronium atoms. A source of microwave energy is operatively interconnected with the container so as to provide microwave energy to a microwave resonator located within the container thereby forming a polarized standing microwave field within which the plurality of positronium atoms rotate.

In another embodiment of the invention, a long-term antimatter storage container includes an evacuated, cryogenic container with sources of positrons and electrons arranged to provide positrons and electrons in capture relation to one another within the container so as to allow for the formation of a plurality of positronium atoms. A source of microwave energy is operatively interconnected with the container so as to provide microwave energy to a fabry-perot microwave resonator located within the container and forming a circularly polarized standing wave within which said plurality of positronium atoms rotate.

In a further embodiment, a method for storing antimatter for a long period is provided in which a plurality of positronium atoms are created within an evacuated, cryogenic container. A circularly polarized standing wave is generated within capture relation to the plurality of positronium atoms, where the circularly polarized standing wave is maintained by the measured addition of microwave energy. Thus a table top resonant cavity operating at 3.8-8.85 GHz with a circularly polarized microwave field of 1.1-4.6 V/cm can be used to store large numbers (upwards of $10^{21}$) of Rydberg Ps atoms with stability and vacuum life times of up to ten days in a vacuum of $10^{-9}$ Torr and temperature of 4° K. The device of the present invention may be energized by a battery-operated magnetron or traveling wave tube, or by wireless transmission from a satellite. In addition, low energy positron accelerators may be used to efficiently fill the cavity in seconds to minutes.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
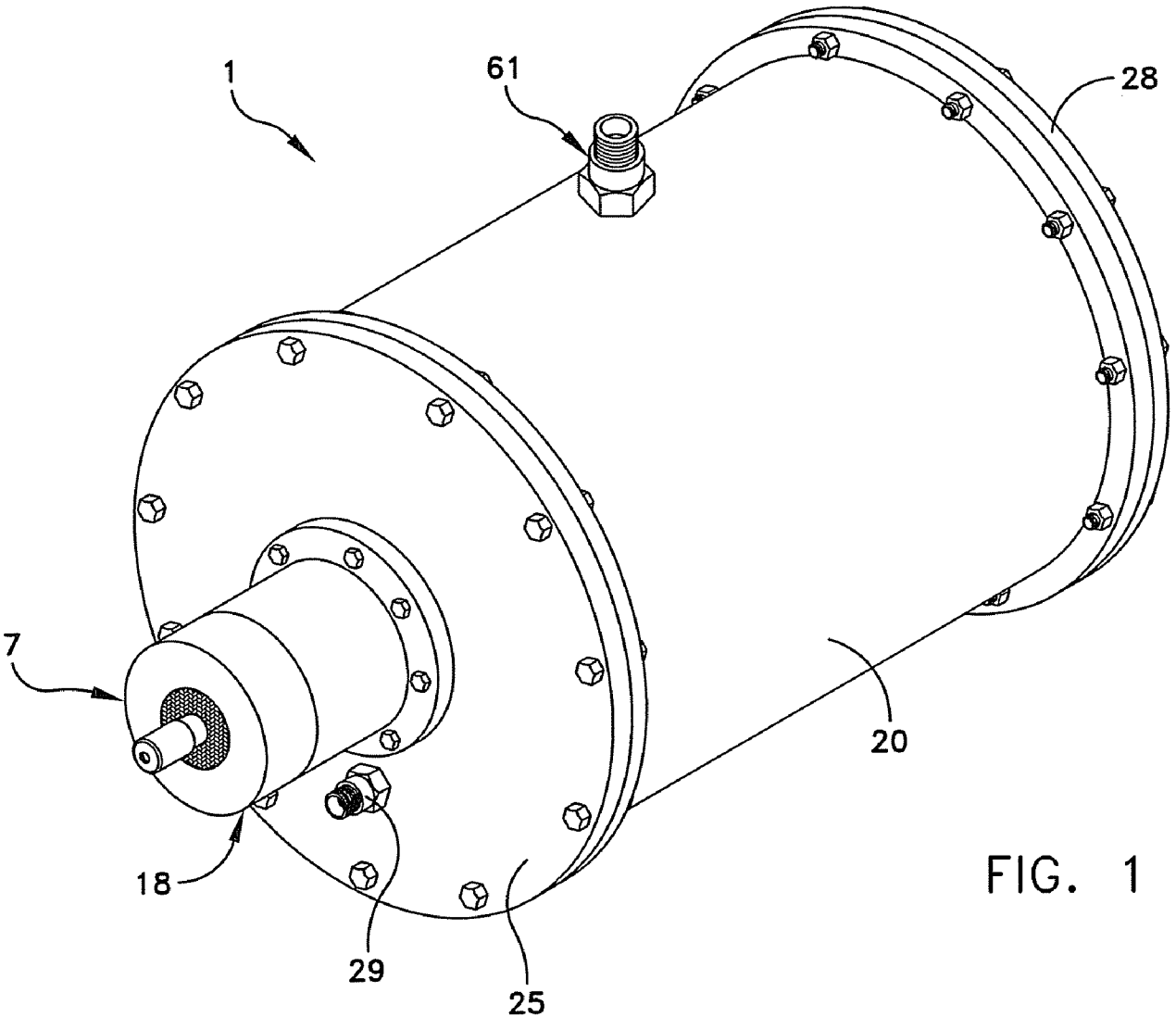
FIG. 1 is a perspective view of an embodiment of the long-term antimatter storage device of the present invention.

This description of preferred embodiments is intended to be read in connection with the accompanying drawings, which are to be considered part of the entire written description of this invention. The drawing figures are not necessarily to scale and certain features of the invention may be shown highly exaggerated in scale or in somewhat schematic form in the interest of clarity and conciseness. For example, the depiction of subatomic particles such as positronium, positrons and electrons in the figures is highly exaggerated in scale. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms such as "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. When only a single device is illustrated, the term "device" shall also be taken to include any collection of devices that individually or jointly execute a portion (or multiple portions) of any one or more of the methodologies discussed herein. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

The present invention provides a long-term antimatter storage device 1 suitable for a variety of applications that advantageously incorporates a resonant cavity 3 that can store large numbers of Rydberg $Ps_2$ molecules 5 with a lifetime of several days in a vacuum of $10^{-9}$ Torr, at temperatures of about 4° K. Long-term antimatter storage device 1 may be energized by a relatively low power magnetron 7, and is capable of functioning autonomously for about several hundred hours on batteries (not shown). Extraction of positrons from long-term antimatter storage device 1 is possible, and radioactive sources of positrons for small stores or low energy positron accelerators for large stores may be employed to efficiently fill embodiments of long-term antimatter storage device 1 in seconds to minutes.

Referring to FIGS. 1-5, one embodiment of long-term antimatter storage device 1 formed in accordance with the present invention includes a dewar 12, an electron/positron capture assembly 15, and a microwave resonator assembly 18. More particularly, dewar 12 includes an often cylindrical outer shell 20 that surrounds and defines a coolant reservoir that is arranged to maintain ultra-low, "cryogenic" temperatures, i.e., no more than 3°-6° above absolute zero, as measured in degrees Kelvin. Outer shell 20 is closed by a front wall 25 and a back wall 28, and is typically formed from stainless steel or the like. A vacuum port 29 is defined within front wall 25 for the evacuation of the interior of resonant cavity 3 to about $10^{-9}$ Torr or so. Often the inner and outer circumferences of outer shell 20 containing sources 30 and ultra-low density materials 32 are coated with thin kapton layers so as to protect the high vacuum within resonance cavity 3.

Electron/positron capture assembly 15 is positioned within dewar 12, and may include a source 30 of positrons 6, such as a $Na^{22}$ source (2.7 year half-life) or other radioactive sources of positrons, whether naturally occurring or man-made, and a variety of ultra-low density materials 32 arranged to provide for electron capture by positrons 6. For example, a segmented $Na^{22}$ source 30 may be arranged within dewar 12 often adjacent to the inner surface of cylindrical outer shell 20 so as to allow a continuous, randomly occurring flow of positrons 6 through ultra-low density material 32. Such a flow of positrons 6 would have energies from 0 keV to about 540 keV, with a mean energy of about 200 keV, and lose energy by collisions with electrons 4 over a distance of about eight millimeters. At nearly the end of their range, positrons 6 form Ps atoms 2 with unpaired electrons in ultra-low density materials 32.

Alternatively, source 30 (e.g., $Na^{22}$) may be replaced with one or more low energy (200 keV) positron accelerator beams directed from a suitable source of positrons (not shown). Various positron sources may be utilized as so-called positron "filling stations" with embodiments of the present invention, including fission reactor based sources or electron linacs that generate positrons in bremsstrahlung showers. In one preferred system, a high energy electron beam circulating in a storage ring with energy passes through a static magnetic undulator, thereby generating gamma rays, which are directed toward a target made of a heavy metal, where the gamma rays pair to produce positrons. For example, one known high-energy electron beam/undulator positron source may deliver a stream or beam of positrons at the rate of $10^{15}$/second, which would fill a resonance cavity 3 of long-term antimatter storage device 1 with about $1\times10^{21}$ $P_s$ atoms in about twelve days. For example, in the Journal Radiation Physics and Chemistry, Vol. 68 (2003) at pages 663-668, Paul L. Csonka of the Department of Physics, and Institute of Theoretical Science, at the University of Oregon, Eugene, Oreg. 97403-5203, USA suggests undulators of the type suggested for use in connection with the present invention, as being efficient for positron production, which article is incorporated herein by reference in its entirety. Csonka has suggested a class of undulator-type positron sources capable of producing high intensities, where an energetic electron beam (either form a linac, or one circulating in an storage ring) passes through a converter target consisting of either real photons, or virtual ones, or atomic material, to produce gamma rays. Those gamma rays, in turn, generate electron-positron pairs through interactions with a second converter target.

In many embodiments of the present invention, ultra-low density materials 32 may comprise aerogels 36 which are known to have exceptionally low density and low thermal conductivity. The term "aerogel" was coined by S. S. Kistler in U.S. Pat. No. 2,188,007 incorporated herein by reference in its entirety, and is generally utilized to refer to a gel which has been dried under supercritical temperature/pressure conditions. In various embodiments of long-term antimatter storage device 1, preferred aerogels have a density of about 0.003-0.35 g/cm$^3$, often about 0.1 g/cm$^3$ and thermal conductivities in vacuum of about 0.004 W/m° K. Aerogels 36 suitable for use with the present invention include both inorganic and organic aerogels, and mixtures thereof. Useful inorganic aerogels include those formed from an inorganic oxide of silicon, aluminum, titanium, zirconium, hafnium, yttrium, vanadium, and the like, with silica aerogels being particularly preferred. Silica aerogels are generally known for being an extremely lightweight transparent solid, comprising densities of less than 0.05 g/cm$^3$ with excellent thermal insulating properties, high temperature stability, very low dielectric constant, and extremely high surface area. Organic aerogels are also suitable for use with the present invention and may be prepared from carbon, polyacrylates, polystyrene, polyacrylonitriles, polyurethanes, polyimides, polyfurfural alcohol, phenol furfuryl alcohol, melamine formaldehydes, resorcinal formaldehydes, cresol, formaldehyde, polycyanurates, polyacrylainides, epoxides, agar, agarose, and the like.

Figure 3:
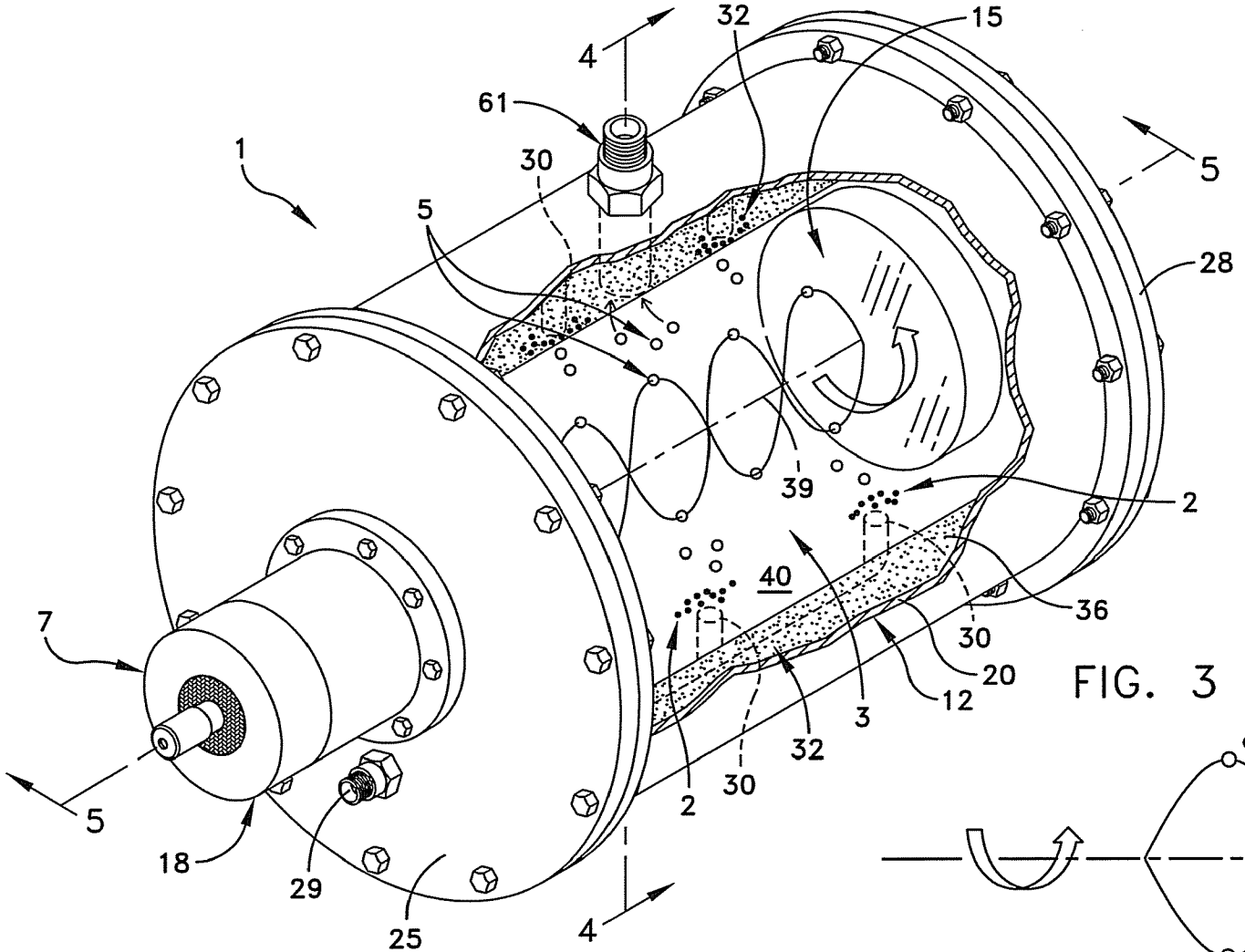
FIG. 3 is a partially broken-away, perspective view of an embodiment of the long-term antimatter storage device of the present invention showing a schematic, classical representation of positronium atoms captured in a circularly polarized standing microwave field.
Figure 2:
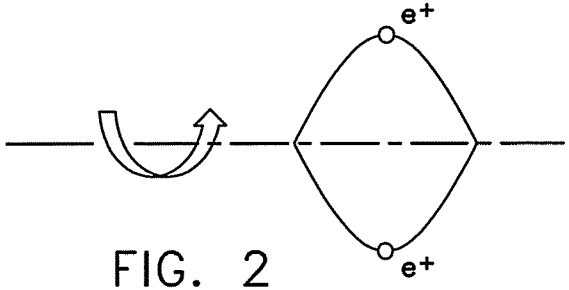
FIG. 2 is a schematic, classical representation of a positron/electron pair forming a positronium atom.
Figure 4:
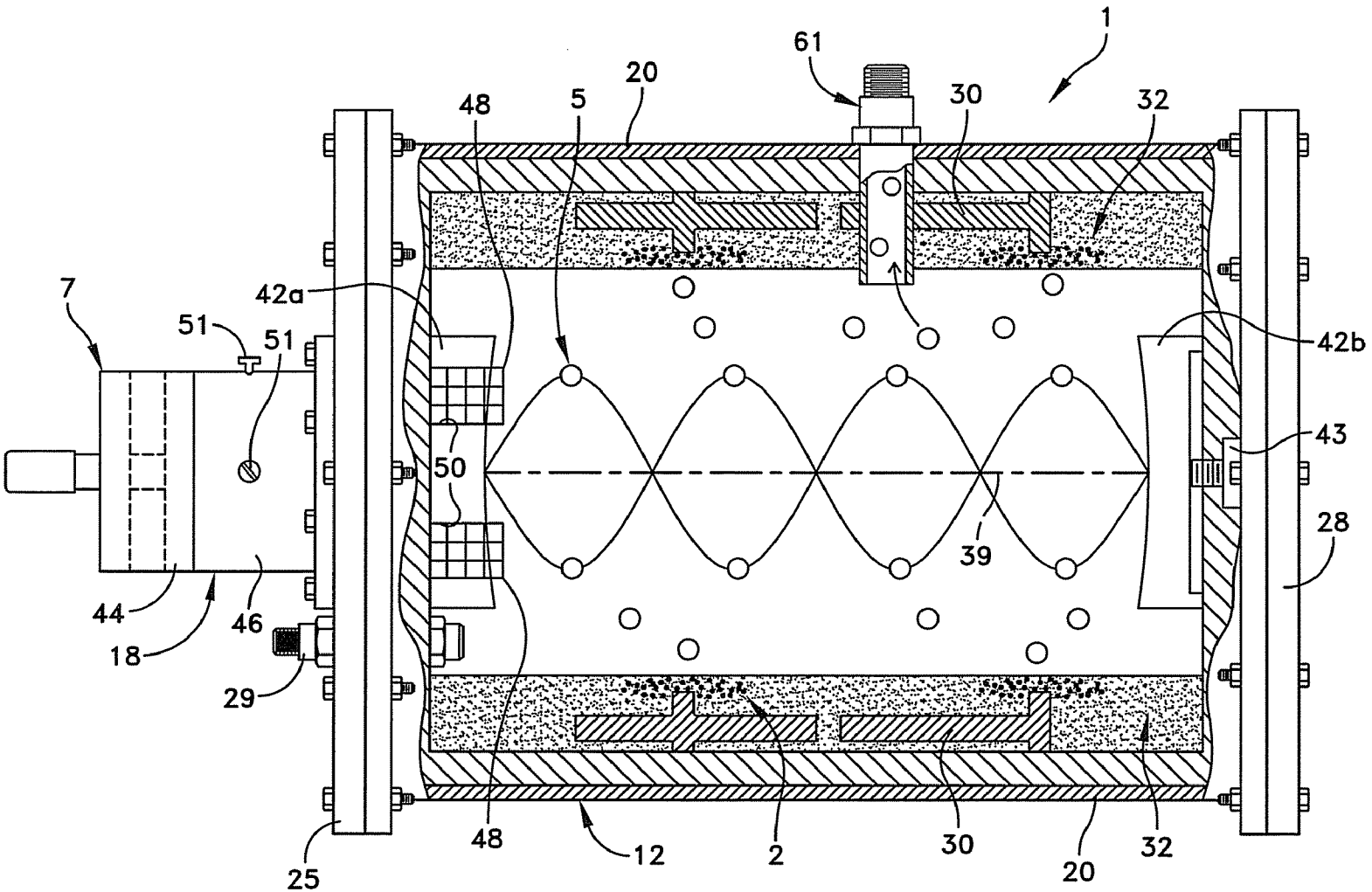
FIG. 4 is a cross-sectional view of one embodiment of a long-term antimatter storage device as taken along lines 4-4 in FIG. 3.
Figure 5:
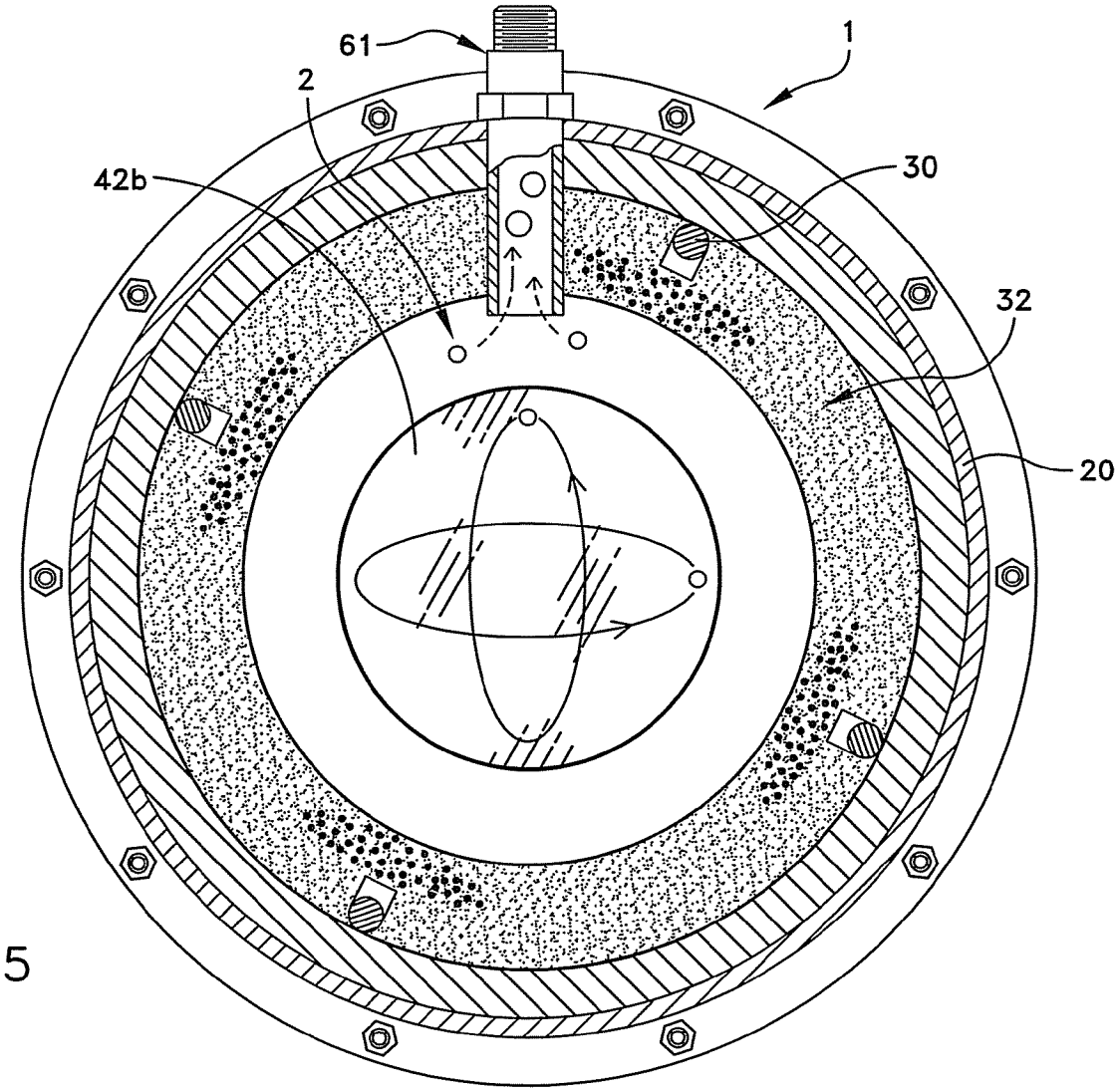
FIG. 5 is another cross-sectional view of one embodiment of a long-term antimatter storage device as taken along lines 5-5 in FIG. 3

For example, with fifty cm$^3$ of silica aerogel of density 0.1 g/cm$^3$, the density of unpaired electrons 4 at low temperature is enhanced by large accumulated doses of radiation imparted by positrons 6 passing through ultra-low density material 32. Exposure to a weak magnetic field, at 4° K, leaves the paramagnetic silica permanently magnetized. With a microwave induced magnetic field at right angles to symmetry axis 39 of resonance cavity 3, positrons 6 travel along magnetic field lines toward resonance cavity 3, forming $P_s$ atoms 2 within a few millimeters of the silica aerogel boundary surface 40 within dewar 12 (FIG. 3). Positrons with energies 0-540 keV (mean 200 keV) lose energy by collisions with electrons in the silica aerogel forming ultra-low density materials 32, traveling 1.8 mm on average and up to 8 mm maximum. Near the end of their range the positrons 6 form Ps atoms 2 with unpaired magnetized electrons 4 in the silica aerogel. In many embodiments of the invention, sources 30 are dispersed through the perimeter of resonance cavity 3 so as to give a homogeneous distribution of Ps atoms 2 within ultra-low density materials 32.

It should be understood that the density of unpaired electrons 4, at low temperature, is enhanced by large accumulated doses of radiation imparted by positrons 6 themselves as they pass through ultra-low density materials 32. For a $Na^{22}$ source 30 the preparatory irradiation time has been found to be relatively short, e.g., one day or less. Concurrent exposure to a weak applied magnetic field, at the 4° K temperature leaves the paramagnetic silica aerogel permanently magnetized. With the remnant magnetic field at or around fifty gauss, positrons 6 are focused along the magnetic field lines. With the field lines pointing toward the center of resonance cavity 3, half of positrons 6 make Rydberg $P_s$ atoms 2 aimed toward central axis 39 within resonance cavity 3. At 10-100 eV energy the mean free path for $P_s$ ionization in silica aerogel and kapton allows approximately 40% of the Rydberg $P_s$ atoms 2 to enter resonance cavity 3 where they are captured by the electric interaction of the microwave field. Specifically, the $P_s$ atom 2 is spin polarized, i.e., the axis of the $P_s$ atom 2 is rotated with the positron outward and the electron inward with their axis parallel to an electric field line of the microwave. A 50 milliCurie (mCi) source 30 may inject $7.4\times10^8$ $P_s$ atoms 2 into resonance cavity 3 per second. A store of $1.2\times10^{13}$ $P_s$ atoms may be achieved in a few hours. Resonance cavity 3 is at $10^{-9}$ Torr pressure and 4 K temperature, maintained initially by external pumping and refrigeration. Insulation and cryo-pumping maintain the temperature and vacuum for several days of operation with batteries.

Microwave resonator assembly 18 is often formed as a Fabry-Perot resonantor having two concave mirrors 42*a* and 42*b*, a magnetron 44, a wave guide 46, and a transmission grid 48. Resonance cavity 3 is defined between concave mirrors 42*a* and 42*b* which are located in coaxially aligned, spaced relation to one another and adjacent to an internal surface of front wall 25 and back wall 28, respectively, of dewar 12. Concave mirrors 42*a* and 42*b* are often formed of copper, silver, or gold. Concave mirror 42*a* is fixed and includes ports 50 cut into concave mirror 42*a* along central symmetry axis 39 for positioning transmission grid 48 in operative relation to resonance cavity 3, while concave mirror 42*b* is movable along central symmetry axis 39 which is common to both concave mirrors. Movable concave mirror 42*b* is often attached to a selectively activated motivator of the type known in the art for producing discreet or continuous controlled linear movements in a structure that is operatively engaged with it, e.g., a servomotor or the like. For example, a motor-driven micrometer 43 may translate concave mirror 42*b* over a range of about 10 millimeters. Based on the equation $\Delta L/L=\Delta\nu/\nu$, the mirror distance L=60 mm must be varied by $\Delta L$=100 μm to change the frequency $\nu$=8 GHz by $\Delta\nu$=0.0133 MHz. A 12 V DC motor operates the motor-driven micrometer 43 with a 1:475 reducing gear and provides a resolution of 0.02 μm with a reproducibility of 0.1 μm. In order to keep microwave resonator assembly 18 in resonance with the microwave frequency, magnetron 44 is frequency modulated with the reference frequency of, e.g., a lock-in amplifier. This frequency modulation effects an amplitude modulation of the power reflected from microwave resonator assembly 18. An AC voltage produced by output signal drives motor-driven micrometer 43 by means of a series of rectangular voltage pulses until microwave resonator assembly 18 exhibits minimum reflection. A reflex klystron (e.g., Varian VRE 2101 A51) provides a microwave frequency at 8 GHz with a power of 10 W. Fixed concave mirror 42*a* is connected to a rectangular U-band waveguide 46 which, in combination with a ports 50 in concave mirror 42*a*, contains the microwave coupling device, e.g., a small dipole antenna. Both concave mirrors 42*a* and 42*b* may have a curvature radius of about 30 millimeters, and often represent a confocal Fabry-Perot resonator.

Magnetron 44 operates with low power requirements, e.g., 1 W, so as to produce microwave energy which enters wave guide 46 via transmission grid 48 where the microwaves are circularly polarized prior to entering resonance cavity 3. Circularly polarized microwaves within resonance cavity 3 have been found to impart sufficient angular momentum to positrons 6 and electrons 4 to dress $P_s$ atoms 2 in a circular orbit with large n, thereby rendering the positron and electron wave packets compact and stable, further suppressing self-annihilation so as to provide longer trapping lifetimes. For example, and assuming 100% coupling between incident and stored microwave power, a circularly polarized microwave beam within resonance cavity 3 with a power of 3.03 mW could pump $10^{21}$ Ps atoms (1 μg). Thus, a circularly polarized microwave driver serves three important purposes in the present invention. First, a circularly polarized microwave driver enhances the separation of electron 4 and positron 6 from each other in a large circular orbit with resonance cavity 3. Second, a circularly polarized microwave driver increases the lifetime against spontaneous radiation to several hours at 4° K. Third, a circularly polarized microwave driver; provides for wave packet stability resulting in negligible overlap of positron 6 and electron 4 wave functions that increases the annihilation lifetime well beyond that for spontaneous radiation.

The wall thickness of concave mirror 42*a* is often about 2 mm within the waveguide cross-section, and sometimes defines a rectangular slit that is arranged parallel to the inner waveguide surfaces. Microwave power is coupled into resonator cavity 3 with a small dipole antenna, often made of copper wire, with a diameter of 0.1 mm. In one embodiment, the wire ends are soldered to the slit walls of a rectangular waveguide, at a distance of one-quarter $\lambda_H$ from the slit, $\lambda_H$ being the waveguide wavelength. The incoming microwave field is reflected at the surface of concave mirror 42*b*. Thus the electric field reaches a maximum in the waveguide cross-section plane where the antenna is connected to waveguide 46, and induces an electric dipole oscillation in the antenna. The antenna radiates a TEM wave field into resonance cavity 3, where a resonance condition is indicated by minimum reflected power. For example, a klystron frequency $\nu$=8 GHz and the peak halfwidth $\Delta\nu$=0.4 MHz allows for a cavity quality value $Q=2\times10^4$. The exact position of the antenna with respect to the concave surface of mirror 42*b* is often found empirically, and may be a compromise between maximum transmission and minimum damping. The microwave coupling be optimized with three phase-shifting screws 51 (0.2 mm) inserted in the wall of waveguide 46 parallel to the electric field vector. A coupling efficiency of almost 100% has been achieved in some embodiments.

Microwave resonator assembly 18 provides an uncomplicated frequency-stable source at millimeter wavelengths in connection with tunable microwave sources like klystrons, back wave oscillator, Gunn diodes or IMPATT diodes and the like sources of microwave energy. In operation, microwaves from low power magnetron 44 travel along wave-guide 46, where they are circularly polarized, prior to entering resonance cavity 3 that has been arranged as a Fabry-Perot resonator, through transmission grid 48 in concave mirror 42*a*. A standing wave is established between concave mirrors 42*a* and 42*b*, the separation of which is an integral multiple of the 0.5 cm wavelength. In a con-focal setup with mirror curvature P and mirror separation L=2P, f and P are related by f=n(c/4P) where c is the speed of light and n is an integer harmonic number. Thus, in one embodiment, where frequency f is equal to 8.5 GHz and a mirror curvature P of three cm, n will equal seven. The quality factor Q of resonance cavity 3 may be represented by $Q=f/\Delta f=V/A\delta$, where V is the volume of resonance cavity 3, A is the area of resonance cavity 3, e.g., $\pi\omega_0^2$ where $\omega_0$ is the microwave beam spot radius, and $\delta$ is the skin depth of copper. In one example, with a volume of fifty, a skin depth of $1.2\times10^{-4}$ cm (300 K, 8.85 GHz) and A=19.6 cm2, a Q of $2.1\times10^{4}$ may be achieved, with $\Delta f$=0.40 MHz. At four degrees K the skin depth is a factor of approximately 4 smaller, resulting in a corresponding increase in Q.

Assuming perfect mode matching at input, the power P inside resonance cavity 3 is $P(W)=\pi\omega_o^2\sqrt{(\in o/\mu_o)}\gamma 2E_{MW}^2/4$, where $\gamma$ is the coupling efficiency for incident power. With $\omega_o$ equal to one cm, $E_{MW}$ equal to fifty V/cm and $\gamma$ equal to 10%, P(W) may equal 52 mW. This amount of power is often sufficient to provide the 1.58 mW needed to stabilize $10^{21}$ Ps atoms. In some embodiments, upwards of $3.3\times10^{22}$ Ps atoms may be stored with sufficient input power. For example, an 8 MJ VDC battery running CW may be used for powering magnetron 44 for several months, i.e., well beyond the estimated vacuum-dependent lifetime against pickoff annihilation. In another embodiment, wireless powering of long-term antimatter storage device 1, via microwave transmission from satellites to other satellites, aircraft, motor vehicles or spacecraft may be utilized. For example, a Satellite Digital Audio Radio Server (SDARS) may transmit circularly polarized microwaves with power densities of 30 mW/cm$^{2\,t}$ to a four cm by four cm receiving antenna to provide the required input power (520 mW) for long-term antimatter storage device 1, thus providing an overall weight reduction and minimal physical servicing being required.

Extraction of positrons 6 from resonance cavity 3 may be accomplished by applying a weak pulsed electric field at right angles to the direction of the standing wave in the center of resonance cavity 3. The maximum travel time of an electromagnetic wave over a full cavity length of about six cm is 0.2 ns, allowing one extraction pulse with a width of 1 ns to ionize all $P_s$ atoms 2 in resonance cavity 3 and accelerate them outward through exit port 61 located within a portion of outer shell 20. In order to avoid pick-off annihilations, $P_s$ antimatter atoms 2 must be kept away from matter. Therefore, $P_s$ atoms 2 must be kept off the walls of outer shell 20. This is achieved in some embodiments of the invention by keeping the edges of the envelope of microwave radiation well within resonance cavity 3 and placing wave nodes on the cavity mirrors 42*a*, 42*b*. Additionally, the density of air within resonance cavity 3 must be low enough to allow for a long lifetime against annihilation of positron with air molecules. For example, a lifetime of ten days requires a vacuum of ~10-9 Torr at 4° K. Also, wave functions of positrons 6 and electrons 4 within the $P_s$ Rydberg atoms 2 must not overlap.

One source of energy dissipation within resonance cavity 3 is synchrotron radiation as the positrons and electrons rotate in their circular orbits. In quantum mechanical terms, the equivalent of synchrotron radiation is the $P_s$ atom losing energy by spontaneous emission of photons estimated to yield a lifetime for this process of 8.3 seconds for n=120. To avoid collapse of the $P_s$ atom to the ground state followed by annihilation, the microwave field is used to force $P_s$ atoms 2 back to their original large orbit (high n state). In classical terms the microwave electric field exerts forces of opposite direction on positron 6 and electron 4. In quantum mechanical terms the microwave field pumps the atom to upward quantum levels by absorption of a succession of photons.

It is to be understood that the present invention is by no means limited only to the particular constructions herein disclosed and shown in the drawings, but also comprises any modifications or equivalents within the scope of the claims.

What is claimed is:

1. An apparatus for the long-term storage of antimatter comprising:

an evacuated, cryogenic container;

a source of positrons and a source of electrons arranged in capture relation to one another within said evacuated, cryogenic container so as to allow for the formation of a plurality of positronium atoms;

a source of microwave energy interconnected with said container; and a microwave resonator located within said evacuated, cryogenic container forming a polarized standing wave microwave field within which said plurality of positronium atoms rotate.

2. An apparatus according to claim 1 wherein said source of positrons comprises a radioactive isotope.

3. An apparatus according to claim 1 wherein said source of positrons comprises as a $Na^{22}$ source.

4. An apparatus according to claim 1 wherein said source of positrons comprises a radioactive isotope positioned within an ultra-low density material arranged to provide for electron capture by positrons emitted from said isotope.

5. An apparatus according to claim 4 wherein said radioactive isotope is segmented and arranged within said container to allow a continuous, randomly occurring flow of positrons through said ultra-low density material.

6. An apparatus according to claim 5 wherein said flow of positrons comprises energies in the range from about keV to about 540 keV, with a mean energy of about 200 keV, and with lose of energy by collisions with electrons within said ultra-low density material over a distance of about eight millimeters so that said positrons form positronium with unpaired electrons from said ultra-low density material.

7. An apparatus according to claim 1 wherein said source of positrons comprises a low energy accelerator beam directed from a source of positrons selected from the group consisting of fission reactors, electron linacs that generate positrons in bremsstrahlung showers, and a high energy electron beam circulating in a storage ring that is caused to pass through a static magnetic undulator, thereby generating gamma rays, which are directed toward a target made of a heavy metal, where the gamma rays pair to produce said positrons.

8. An apparatus according to claim 1 wherein said source of electrons comprises an ultra-low density material.

9. An apparatus according to claim 8 wherein said ultra-low density material comprises an aerogel having a density in the range from about 0.003 g/cm$^3$ to about 0.35 g/cm$^3$.

10. An apparatus according to claim 9 wherein said ultra-low density material comprises a silica aerogel having a density of about 0.1 g/cm$^3$.

11. An apparatus according to claim 9 wherein said ultra-low density material comprises an aerogel formed from an inorganic oxide of silicon wherein selected from the group consisting of aluminum oxide, titanium oxide, zirconium oxide, hafnium oxide, yttrium oxide, and vanadium oxide.

12. An apparatus according to claim 9 wherein said ultra-low density material comprises an organic aerogel prepared from the group of organic materials consisting of carbon, polyacrylates, polystyrene, polyacrylonitriles, polyurethanes, polyimides, polyfurfural alcohol, phenol furfuryl alcohol, melamine formaldehydes, resorcinal formaldehydes, cresol, formaldehyde, polycyanurates, polyacrylainides, epoxides, agar, and agarose.

13. An apparatus for the long-term storage of antimatter comprising:

an evacuated, cryogenic container;

a source of positrons and a source of electrons;

a plurality of positrons and electrons provided by said source of positrons and said source of electrons so as to be in capture relation to one another within said evacuated, cryogenic container so as to allow for the formation of a plurality of positronium atoms;

a source of microwave energy interconnected with said container; and a fabry-perot, microwave resonator located within said evacuated, cryogenic container forming a circularly polarized standing wave within which said plurality of positronium atoms rotate.

14. An apparatus according to claim 13 wherein said microwave resonator includes two concave mirrors that are located within said container so as to define a resonance cavity, and that are operatively interconnected with a container mounted magnetron so as to interface with a wave guide and a microwave transmission grid associated with one of said two mirrors.

15. An apparatus according to claim 14 wherein said concave mirrors are located in coaxially aligned, spaced relation to one another within said container, wherein one of said concave mirror is fixed and includes port for positioning said transmission grid operative relation to resonance cavity and the other of said concave mirrors is movable along central symmetry axis which is common to both concave mirrors.

16. An apparatus according to claim 15 wherein said movable concave mirror is attached to a selectively activated motivator for producing at least one of discreet and continuous controlled linear movements.

17. An apparatus according to claim 14 wherein said magnetron operates with low power in the range from about 1 W to about 10 W, so as to produce microwave energy which enters said wave guide via said transmission grid where the microwaves are circularly polarized prior to entering said resonance cavity thereby to impart sufficient angular momentum to positrons and electrons to dress positronium atoms formed from said positrons and electrons in a circular orbit with large n, thereby rendering the positron and electron wave packets compact and stable, so as to suppress self-annihilation.

18. An apparatus according to claim 17 wherein said circularly polarized microwave driver (i) enhances the separation of said electrons and positrons forming each of said positronium atoms from each other in a large circular orbit within said resonance cavity, (ii) increases the lifetime of said positronium atoms against spontaneous radiation to several hours at 2° K, and (iii) provides for wave packet stability resulting in negligible overlap of positron and electron wave functions so as to increase an annihilation lifetime.

19. An apparatus according to claim 14 wherein said microwave resonator comprises a tunable microwave source selected from the group consisting of klystrons, back wave oscillator, Gunn diodes and IMPATT diodes.

20. An apparatus according to claim 14 wherein microwaves generated by said container mounted magnetron travel along said wave-guide, where they are circularly polarized prior to entering said resonance cavity through said transmission grid in said fixed concave mirror so that a standing wave is established said two concave mirrors wherein a separation of said two concave mirrors defines an integral multiple of a wavelength.

21. An apparatus according to claim 13 wherein said source of microwave energy is transmitted between an earth orbiting satellites through a Satellite Digital Audio Radio Server that transmits circularly polarized microwaves to a receiving antenna located on said container so as to provide microwave energy to said microwave resonator.

22. A method for storing antimatter for a long period comprising the steps of:

(A) creating a plurality of positronium atoms within an evacuated, cryogenic container;

(B) generating a circularly polarized standing wave within capture relation to said plurality of positronium atoms; and (C) maintaining said circularly polarized standing wave by the measured addition of microwave energy.

* * * * *